US009883720B1

(12) United States Patent
Calegari et al.

(10) Patent No.: US 9,883,720 B1
(45) Date of Patent: Feb. 6, 2018

(54) ZIPPER CAPABLE OF GENERATING A DISTINCTIVE SOUND

(71) Applicants: Terra Calegari, Incline Village, NV (US); Alex Kanwetz, Incline Village, NV (US)

(72) Inventors: Terra Calegari, Incline Village, NV (US); Alex Kanwetz, Incline Village, NV (US)

( * ) Notice: Subject to any disclaimer, the term of this patent is extended or adjusted under 35 U.S.C. 154(b) by 0 days.

(21) Appl. No.: 15/190,096

(22) Filed: Jun. 22, 2016

Related U.S. Application Data

(60) Provisional application No. 62/183,702, filed on Jun. 23, 2015.

(51) Int. Cl.

| | |
|---|---|
| ***G10F 1/06*** | (2006.01) |
| ***A44B 19/24*** | (2006.01) |
| ***A44B 19/02*** | (2006.01) |
| ***A45C 1/02*** | (2006.01) |
| ***A45C 1/06*** | (2006.01) |
| ***A45C 3/06*** | (2006.01) |
| ***A45C 3/00*** | (2006.01) |
| ***A45C 5/03*** | (2006.01) |
| ***A45C 13/10*** | (2006.01) |
| ***G10D 13/08*** | (2006.01) |

(52) U.S. Cl.
CPC ..... *A44B 19/24* (2013.01); *A44B 19/02* (2013.01); *A45C 1/02* (2013.01); *A45C 1/06* (2013.01); *A45C 3/00* (2013.01); *A45C 3/06* (2013.01); *A45C 5/03* (2013.01); *A45C 13/103* (2013.01); *G10D 13/08* (2013.01)

(58) Field of Classification Search
CPC ... A45C 13/103; A45C 7/0068; A45C 7/0027; A44B 19/26; A44B 19/00
See application file for complete search history.

(56) References Cited

U.S. PATENT DOCUMENTS

| | | | | |
|---|---|---|---|---|
| 6,596,955 | B2 * | 7/2003 | Eves | H01H 1/12 200/550 |
| 9,622,550 | B2 * | 4/2017 | Whiton | A44B 19/285 |
| 2005/0069147 | A1 * | 3/2005 | Pedersen | H04M 1/05 381/74 |
| 2006/0218758 | A1 * | 10/2006 | Chang | A44B 19/262 24/431 |
| 2007/0135953 | A1 * | 6/2007 | Crow | H04R 5/023 700/94 |
| 2014/0259561 | A1 * | 9/2014 | Hernandez | A44B 19/262 24/415 |
| 2014/0331835 | A1 | 11/2014 | Kosub et al. | |

(Continued)

*Primary Examiner* — Marlon Fletcher
(74) *Attorney, Agent, or Firm* — Clause Eight IPS; Michael Catania

(57) ABSTRACT

A zipper without electrical components that generates a distinctive sound when the zipper is opened or closed is disclosed herein. The zipper comprises a slider, a first and a second track. The slider comprises a plurality of tone bars and a plurality of audio openings. The first track comprises a plurality of zipper teeth. The second track comprises a plurality of zipper teeth. Each zipper tooth of the plurality of zipper teeth of the first track and the second track comprises at least one raised portion. The slider is configured to generate a musical sound when the slider is slid over the first track and the second track.

20 Claims, 13 Drawing Sheets

(56) References Cited

U.S. PATENT DOCUMENTS

| | | | | |
|---|---|---|---|---|
| 2015/0016655 | A1* | 1/2015 | Groset | H04R 1/1033<br>381/384 |
| 2015/0082582 | A1* | 3/2015 | Whiton | A44B 19/26<br>24/418 |

* cited by examiner

| Beam Properties | | Mass Properties | | Material Properties | | May Be Modified | |
|---|---|---|---|---|---|---|---|
| b = | 0.00045 m | V = | 1.6E-09 m^3 | E = | 2.1E+11 Pa | | |
| h = | 0.00025 m | M = | 1.26E-05 kg | ρ = | 7860 kg/m^3 | | |
| A = | 1.125E-07 m^2 | | | | | | |
| I = | 5.88938E-16 m^4 | | | | | | |

Allowed difference [Hz]: 0.3

| | B2 | C3 | C#3/Db3 | D3 | D#3/Eb3 | E3 | F3 | F#3/Gb3 | G3 | G#3/Ab3 | A3 | A#3/Bb3 | B3 | C4 | C#4/Db4 | D4 | D#4/Eb4 | E4 |
|---|---|---|---|---|---|---|---|---|---|---|---|---|---|---|---|---|---|---|
| MIN L [m] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| MAX L [m] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| FREQ [Hz] | 123.4708253 | 130.8128 | 138.5913 | 146.8324 | 155.5635 | 164.8138 | 174.6141 | 184.9972 | 195.9977 | 207.6523 | 220 | 233.0819 | 246.9417 | 261.6256 | 277.1826 | 293.6648 | 311.127 | 329.6276 |

| Beam Properties | | Mass Properties | | Calculated Frequency [Hz] | | May Be Modified | |
|---|---|---|---|---|---|---|---|
| b = | 0.0005 m | V = | 1.6E-09 m^3 | E = | 2.1E+11 Pa | | |
| h = | 0.00025 m | M = | 1.26E-05 kg | ρ = | 7860 kg/m^3 | | |
| A = | 0.000000125 m^2 | | | | | | |
| I = | 6.51042E-16 m^4 | | | | | | |

Allowed difference [Hz]: 0.25

| | B2 | C3 | C#3/Db3 | D3 | D#3/Eb3 | E3 | F3 | F#3/Gb3 | G3 | G#3/Ab3 | A3 | A#3/Bb3 | B3 | C4 | C#4/Db4 | D4 | D#4/Eb4 | E4 |
|---|---|---|---|---|---|---|---|---|---|---|---|---|---|---|---|---|---|---|
| MIN L [m] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| MAX L [m] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| FREQ [Hz] | 123.4708253 | 130.8128 | 138.5913 | 146.8324 | 155.5635 | 164.8138 | 174.6141 | 184.9972 | 195.9977 | 207.6523 | 220 | 233.0819 | 246.9417 | 261.6256 | 277.1826 | 293.6648 | 311.127 | 329.6276 |

| Beam Properties | | Mass Properties | | Material Properties | | May Be Modified | |
|---|---|---|---|---|---|---|---|
| b = | 0.0005 m | V = | 1.6E-09 m^3 | E = | 2.1E+11 Pa | | |
| h = | 0.00025 m | M = | 1.26E-05 kg | ρ = | 7860 kg/m^3 | | |
| A = | 0.000000125 m^2 | | | | | | |
| I = | 1.125E-15 m^4 | | | | | | |

Allowed difference [Hz]: 1

| | D3 | D#3/Eb3 | E3 | F3 | F#3/Gb3 | G3 | G#3/Ab3 | A3 | A#3/Bb3 | B3 | C4 | C#4/Db4 | D4 | D#4/Eb4 | E4 | F4 | F#4/Gb4 | G4 |
|---|---|---|---|---|---|---|---|---|---|---|---|---|---|---|---|---|---|---|
| MIN L [m] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| MAX L [m] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| FREQ [Hz] | 146.832384 | 155.5635 | 164.8138 | 174.6141 | 184.9972 | 195.9977 | 207.6523 | 220 | 233.0819 | 246.9417 | 261.6256 | 277.1826 | 293.6648 | 311.127 | 329.6276 | 349.2282 | 369.9944 | 391.9954 |

| Beam Properties | | Mass Properties | | Calculated Frequency [Hz] | | May Be Modified | |
|---|---|---|---|---|---|---|---|
| b = | 0.0005 m | V = | 1.6E-09 m^3 | E = | 2.1E+11 Pa | | |
| h = | 0.0004 m | M = | 1.26E-05 kg | ρ = | 7860 kg/m^3 | | |
| A = | 0.0000002 m^2 | | | | | | |
| I = | 2.66667E-15 m^4 | | | | | | |

Allowed difference [Hz]: 0.4

| | G3 | G#3/Ab3 | A3 | A#3/Bb3 | B3 | C4 | C#4/Db4 | D4 | D#4/Eb4 | E4 | F4 | F#4/Gb4 | G4 | G#4/Ab4 | A4 | A#4/Bb4 |
|---|---|---|---|---|---|---|---|---|---|---|---|---|---|---|---|---|
| MIN L [m] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| MAX L [m] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| FREQ [Hz] | 195.997718 | 207.6523 | 220 | 233.0819 | 246.9417 | 261.6256 | 277.1826 | 293.6648 | 311.127 | 329.6276 | 349.2282 | 369.9944 | 391.9954 | 415.3047 | 440 | 466.1638 |

| Beam Properties | | Mass Properties | | Calculated Frequency [Hz] | | May Be Modified | |
|---|---|---|---|---|---|---|---|
| b = | 0.0005 m | V = | 1.6E-09 m^3 | E = | 2.1E+11 Pa | | |
| h = | 0.00045 m | M = | 1.26E-05 kg | ρ = | 7860 kg/m^3 | | |
| A = | 0.000000225 m^2 | | | | | | |
| I = | 3.79688E-15 m^4 | | | | | | |

Allowed difference [Hz]: 0.575

| | A3 | A#3/Bb3 | B3 | C4 | C#4/Db4 | D4 | D#4/Eb4 | E4 | F4 | F#4/Gb4 | G4 | G#4/Ab4 | A4 | A#4/Bb4 | B4 | C5 | C#5/Db5 | D5 |
|---|---|---|---|---|---|---|---|---|---|---|---|---|---|---|---|---|---|---|
| MIN L [m] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| MAX L [m] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
| FREQ [Hz] | 220 | 233.0819 | 246.9417 | 261.6256 | 277.1826 | 293.6648 | 311.127 | 329.6276 | 349.2282 | 369.9944 | 391.9954 | 415.3047 | 440 | 466.1638 | 493.8833 | 523.2511 | 554.3653 | 587.3295 |

FIG. 18

ZIPPER CAPABLE OF GENERATING A DISTINCTIVE SOUND

CROSS REFERENCE TO RELATED APPLICATION

The Present Application claims priority to U.S. Patent Application No. 62/183,702, filed on Jun. 23, 2015, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention generally relates to zippers.

Description of the Related Art

The prior art discusses various zippers that can generate sound.

Chang, U.S. Patent Publication Number 20060218758 for a Zipper discloses a zipper that includes sound and light arranged in a pulling member.

Crow, U.S. Patent Publication Number 20070135953 for a Zipper Speaker discloses a zipper that includes a small electronic device as part of a pull tab of the zipper.

Kosub et al, U.S. Patent Publication Number 20140331835 for an Apparatus For Manufacturing Reclosable Bag Material With Audible Closure discloses a reclosable bag which when opened or closed using a zipper generates a sound.

However, the prior art fails to disclose a zipper mechanism that generates a sound by movement of the zipper along the zipper tracks.

BRIEF SUMMARY OF THE INVENTION

The present invention provides a zipper without electrical components that generates a distinctive sound when the zipper is opened or closed.

One aspect of the present invention is a zipper capable of generating music or a distinctive sound. The zipper comprises a slider, a first and a second track. The slider comprises a plurality of tone bars and a plurality of audio openings. The first track comprises a plurality of zipper teeth. The second track comprises a plurality of zipper teeth. Each zipper tooth of the plurality of zipper teeth of the first track and the second track comprises at least one raised portion. The slider is configured to generate a musical sound when the slider is slid over the first track and the second track.

Another aspect of the present invention is an article of clothing having a zipper capable of generating music or a distinctive sound. The article of clothing comprises a clothing body having an opening with a first side and a second side, a first track comprising a plurality of zipper teeth, the first track positioned on the first side of the opening of the clothing body, a second track comprising a plurality of zipper teeth, the second track positioned on the second side of the opening of the clothing body, and a slider comprising a plurality of tone bars and a plurality of audio openings. Each zipper tooth of the plurality of zipper teeth of the first track and the second track comprises at least one raised portion. The slider is configured to generate a musical sound when the slider is slid over the first track and the second track.

Yet another aspect of the present invention is an article having a zipper capable of generating music or a distinctive sound. The article comprises a body having an opening with a first side and a second side, a first track comprising a plurality of zipper teeth, the first track positioned on the first side of the opening of the body, a second track comprising a plurality of zipper teeth, the second track positioned on the second side of the opening of the body, and a slider comprising a plurality of tone bars and a plurality of audio openings. Each zipper tooth of the plurality of zipper teeth of the first track and the second track comprises at least one raised portion. The slider is configured to generate a musical sound when the slider is slid over the first track and the second track. The article can be hand bags, luggage, duffels, a wallet, a purse or clothing.

A modified zipper incorporates a sound comb that has a mechanism that produces desired tones. A channel system is preferably used to activate and deactivate the sound comb. Pins are each zipper tooth strike the sound comb when a zipper is moved up and down along zipper tracks.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 18 is a table of properties for various embodiments of sound combs.

DETAILED DESCRIPTION OF THE INVENTION

Figure 1:
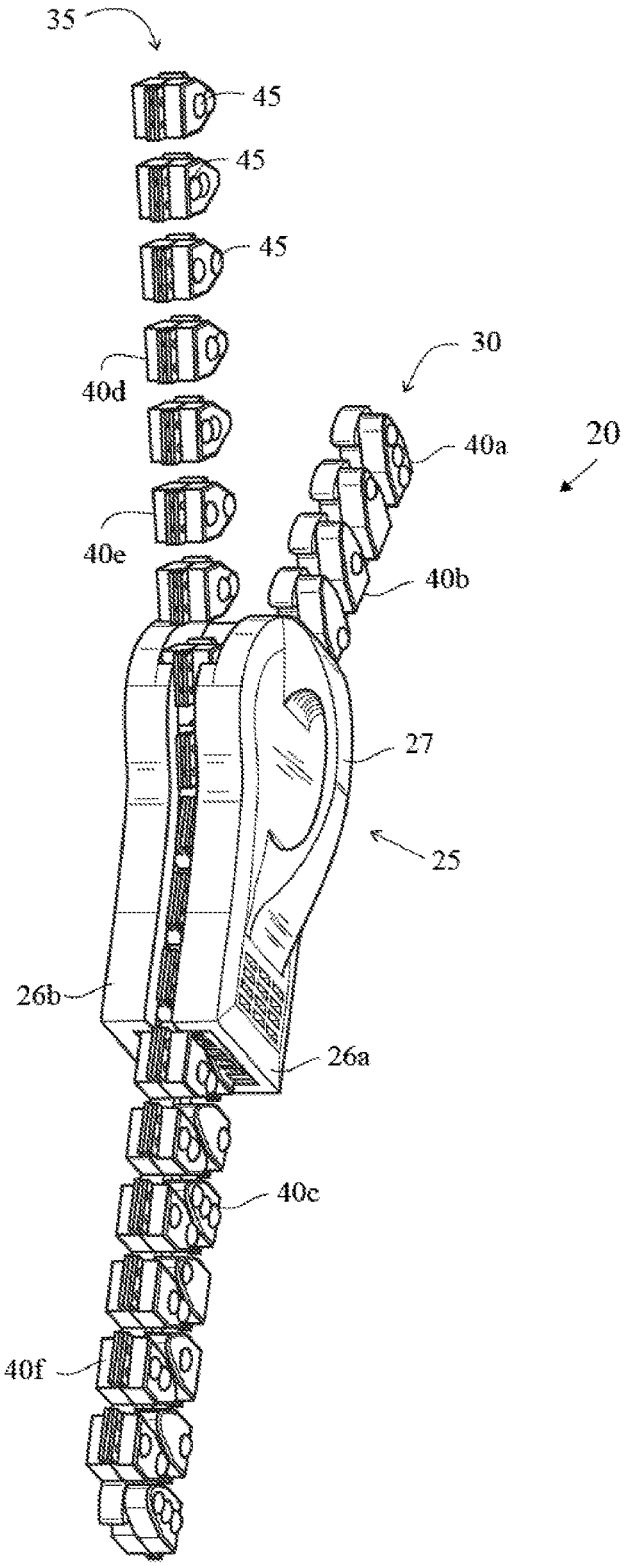
FIG. 1 is an isolated view of a zipper for generating a distinctive sound showing the slider and the tracks.
Figure 2:
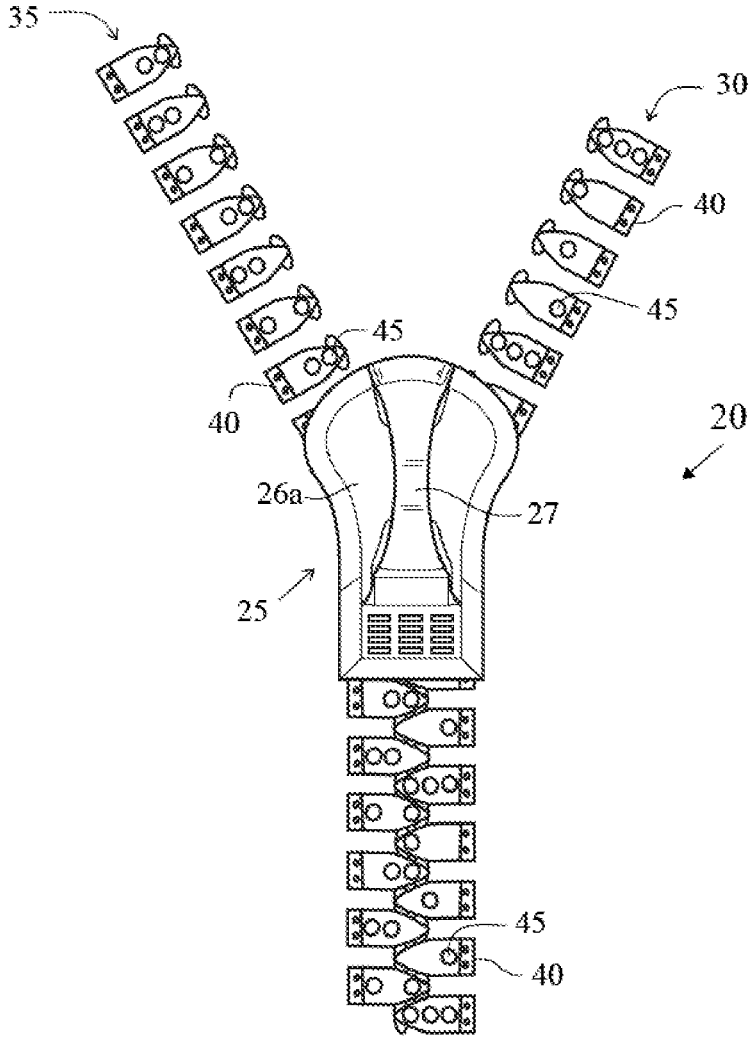
FIG. 2 is a top plan view of a zipper for generating a distinctive sound showing the slider and the tracks.

As shown in FIGS. 1-4, the zipper 20 comprises a slider 25, a first track 30 and a second track 32. The slider 25 comprises a plurality of tone bars 29 and a plurality of audio openings 22. The first track 30 comprises a plurality of zipper teeth 40. The second track 32 comprises a plurality of zipper teeth 40. Each zipper tooth 40 of the plurality of zipper teeth 40 of the first track 30 and the second track 32 comprises at least one raised portion 45. The slider 25 is configured to generate a musical sound when the slider 25 is slid over the first track 30 and the second track 32.

The slider 25 comprises a first opening 28 and a second opening 31 (or multiple second openings 31*a* and 31*b*) for joining the first track 30 with the second track 32 and separating the first track 30 from the second track 32.

The slider 25 comprises a pull mechanism 27, a first body 26*a* and a second body 26*b*, wherein the tone bars 29 and the audio openings 22 are preferably positioned on the first body 26*a*. The audio openings 22 preferably range from four to twenty openings 22, and more preferably eight to sixteen openings 22. The tone bars 29 preferably range from four to twenty bars 29, and more preferably eight to sixteen bars 29.

Figure 3:
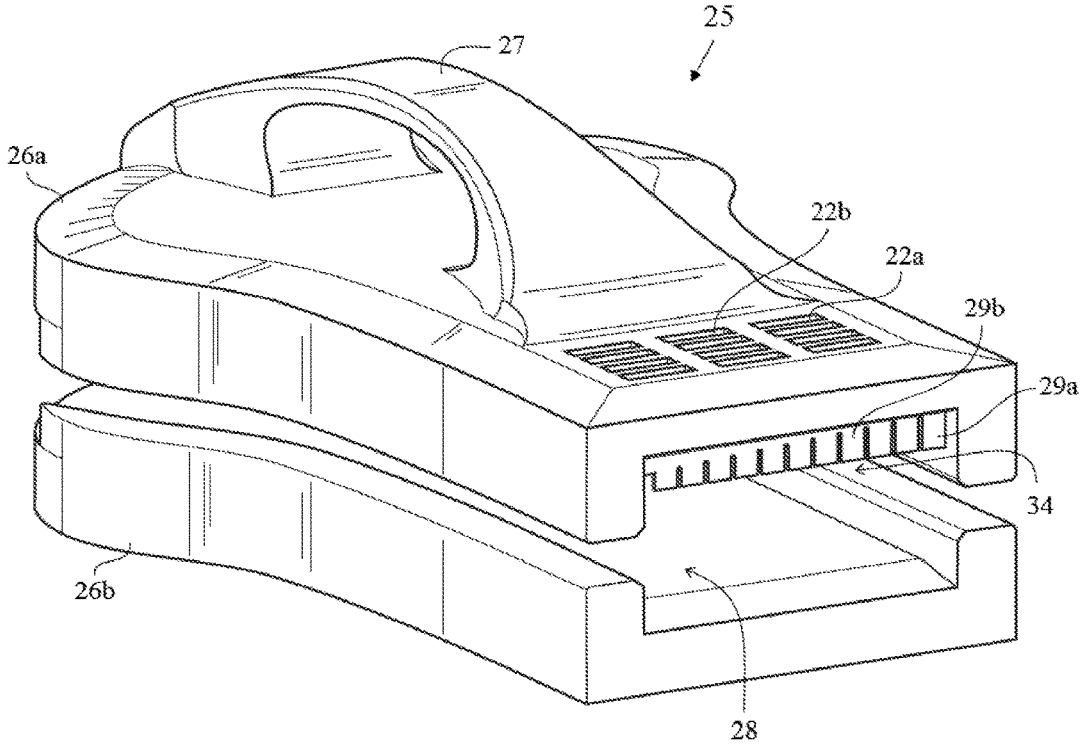
FIG. 3 is an isolated view of a slider for a zipper for generating a distinctive sound.
Figure 4:
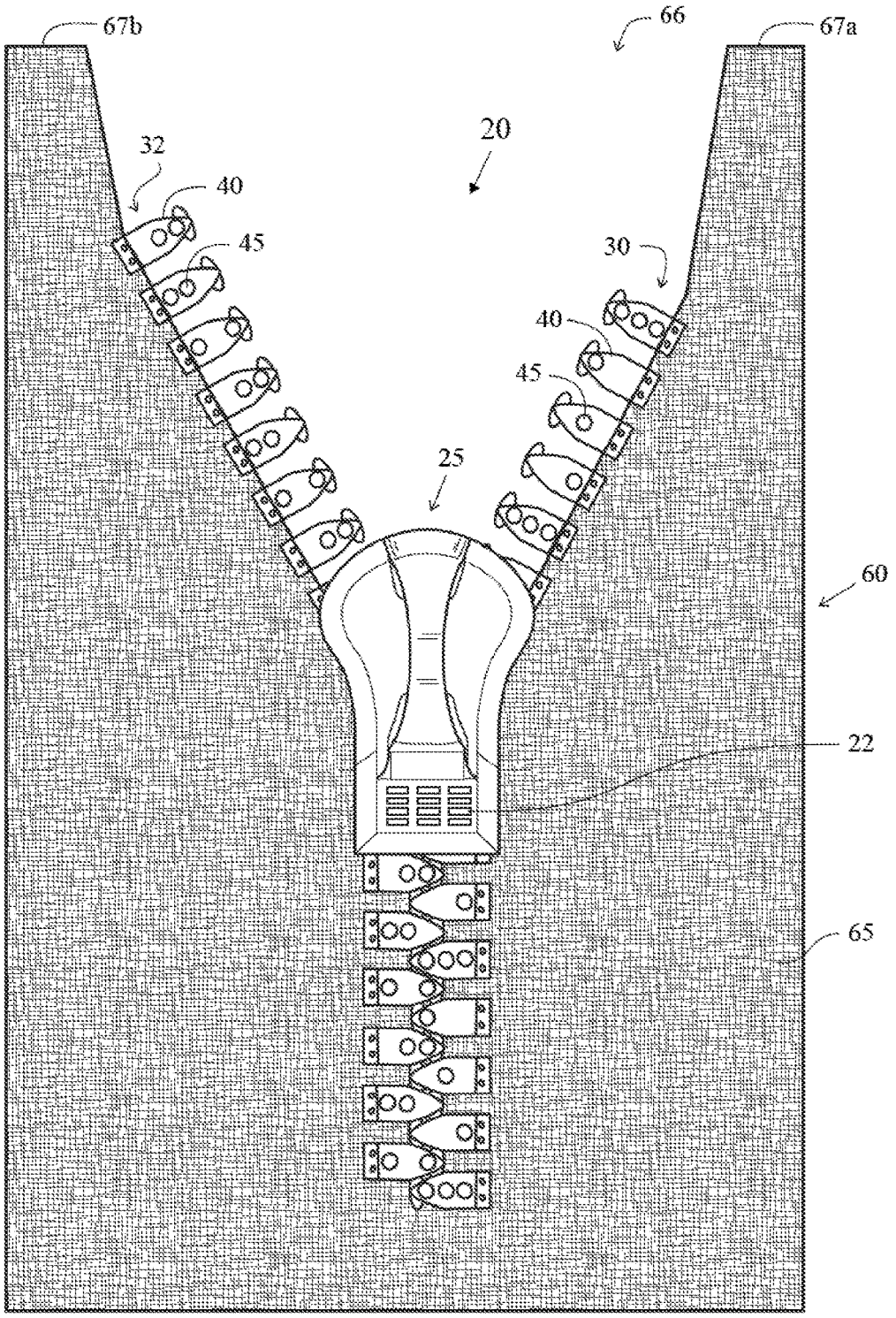
FIG. 4 illustrates clothing having a zipper for generating a distinctive sound.
Figure 5:
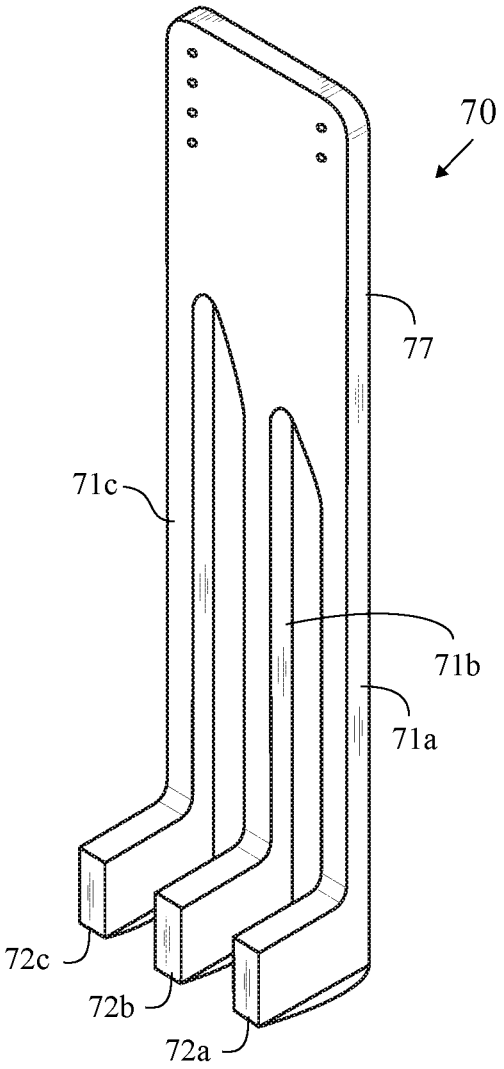
FIG. 5 is a top perspective view of a sound comb for a slider for a zipper for generating a distinctive sound.
Figure 6:
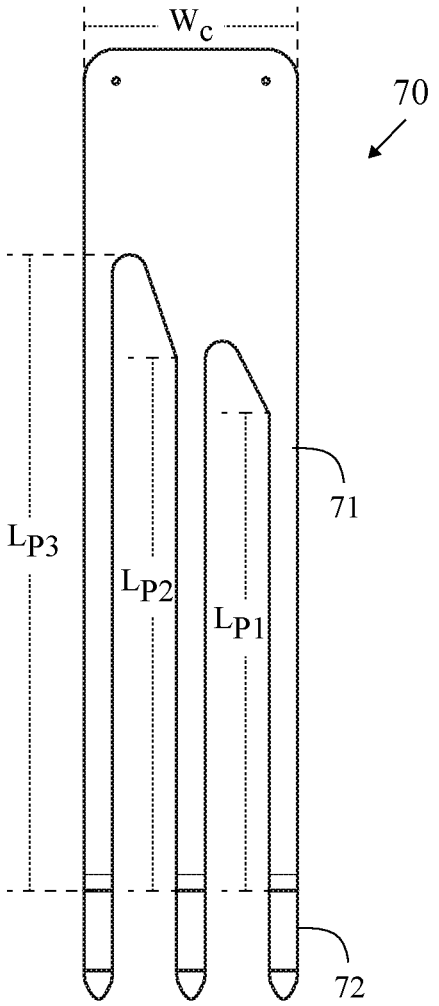
FIG. 6 is a front elevation view of a sound comb for a slider for a zipper for generating a distinctive sound.
Figure 7:
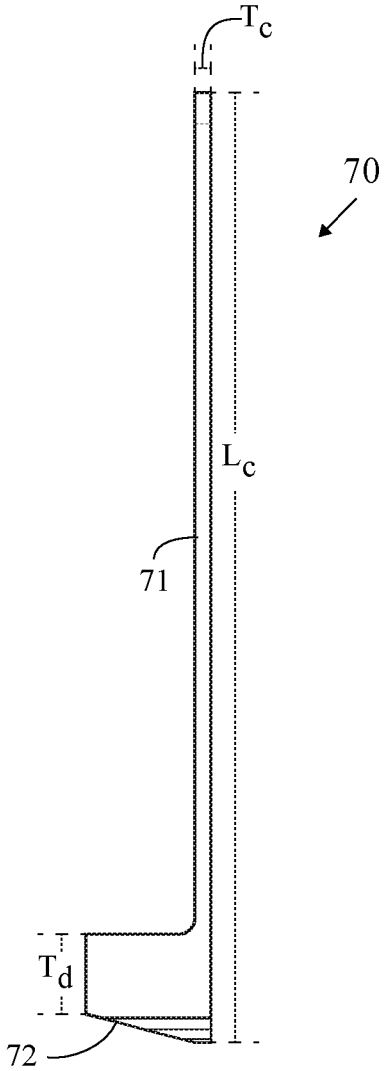
FIG. 7 is a side elevation view of a sound comb for a slider for a zipper for generating a distinctive sound.
Figure 8:
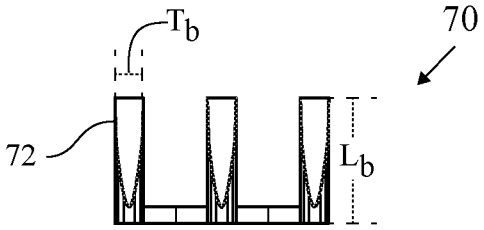
FIG. 8 is a bottom plan view of a sound comb for a slider for a zipper for generating a distinctive sound.
Figure 9:
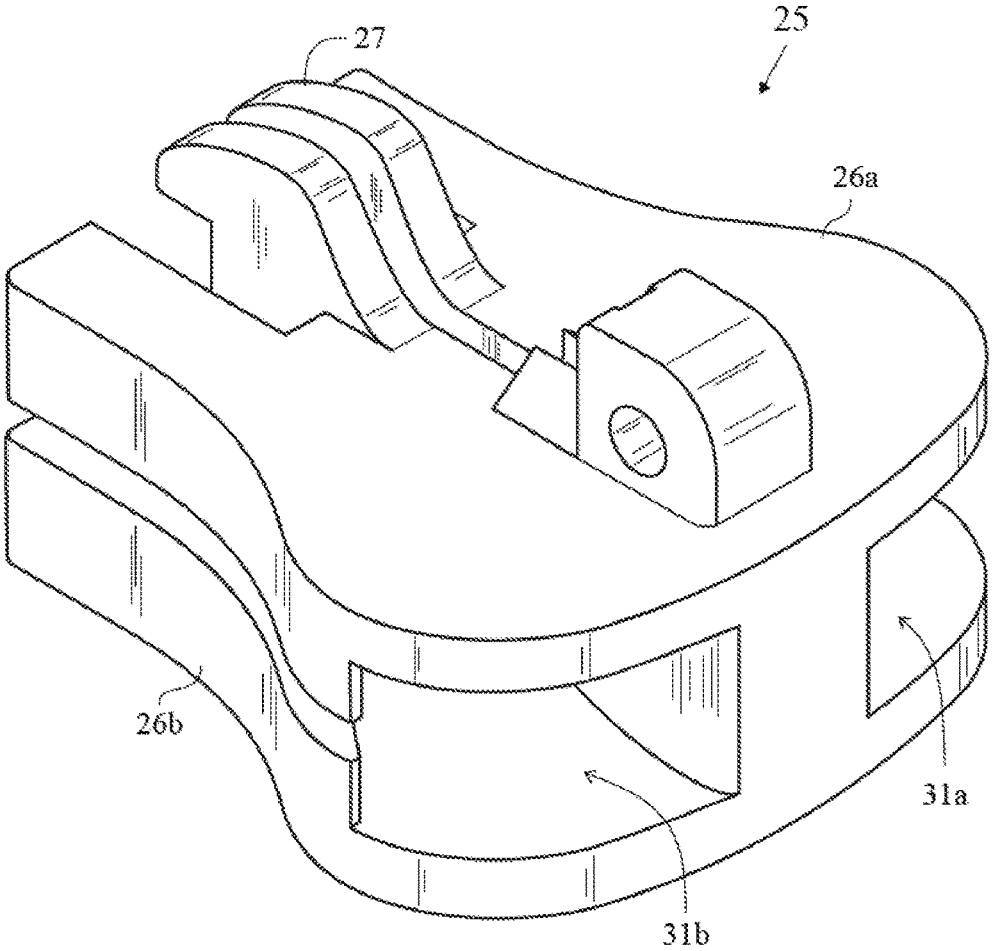
FIG. 9 is a top perspective view of a slider for a zipper for generating a distinctive sound.
Figure 10:
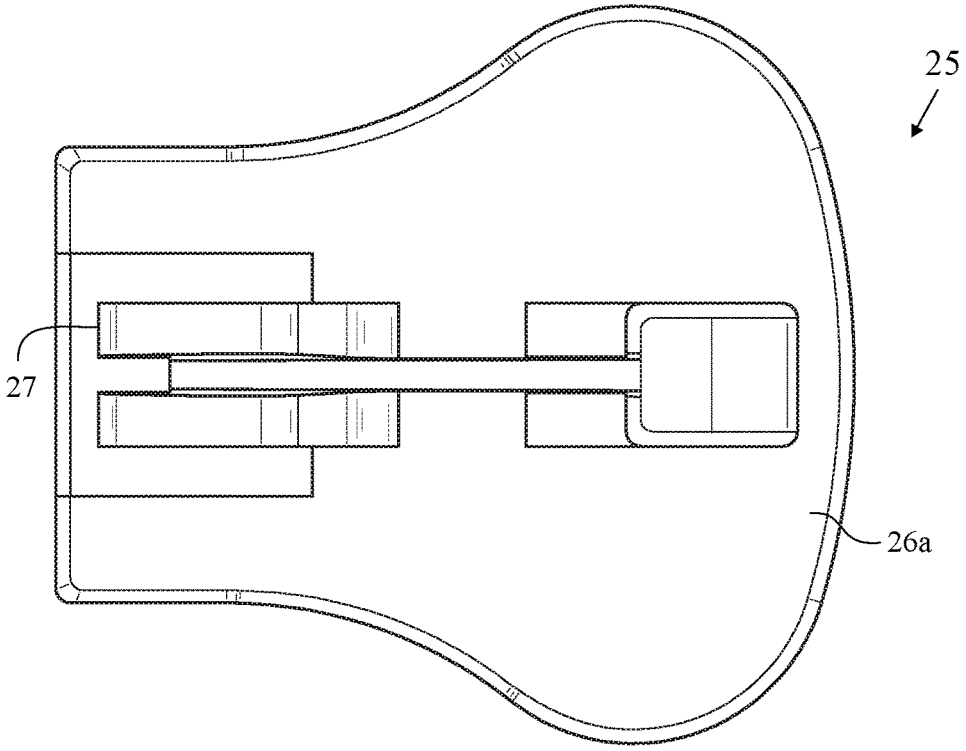
FIG. 10 is a top plan view of a slider for a zipper for generating a distinctive sound.
Figure 11:
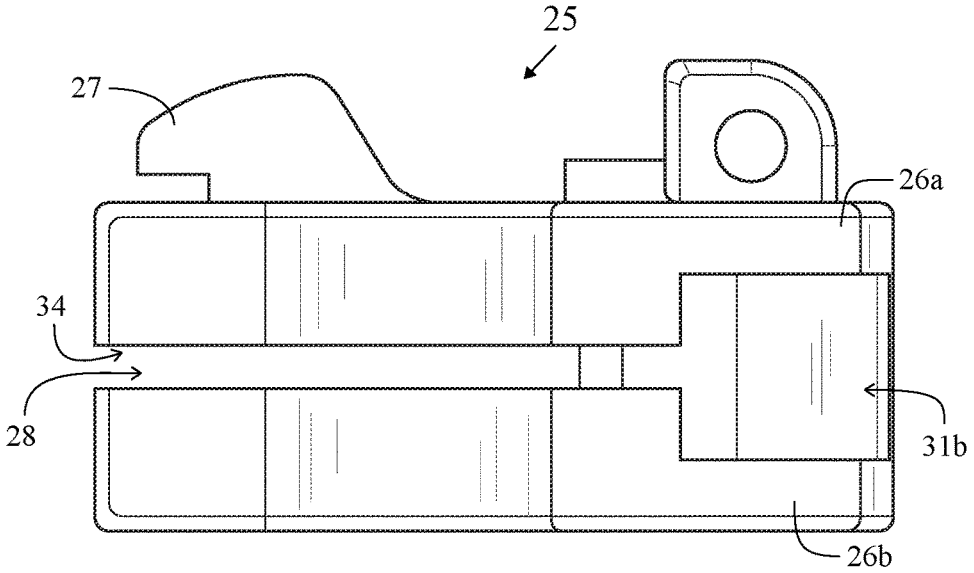
FIG. 11 is a side elevation view of a slider for a zipper for generating a distinctive sound.
Figure 12:
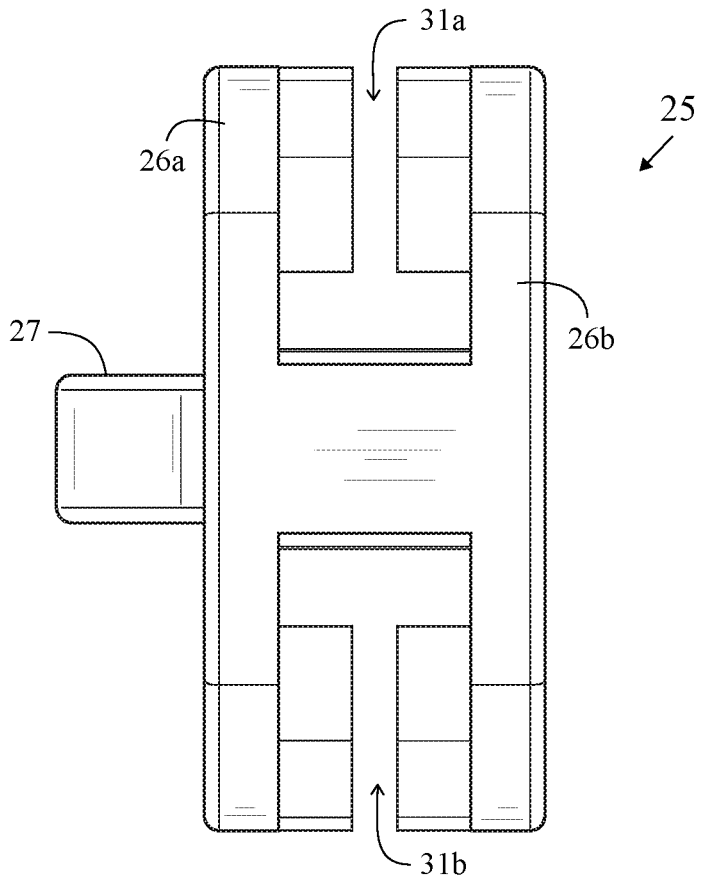
FIG. 12 is a front elevation view of a slider for a zipper for generating a distinctive sound.
Figure 13:
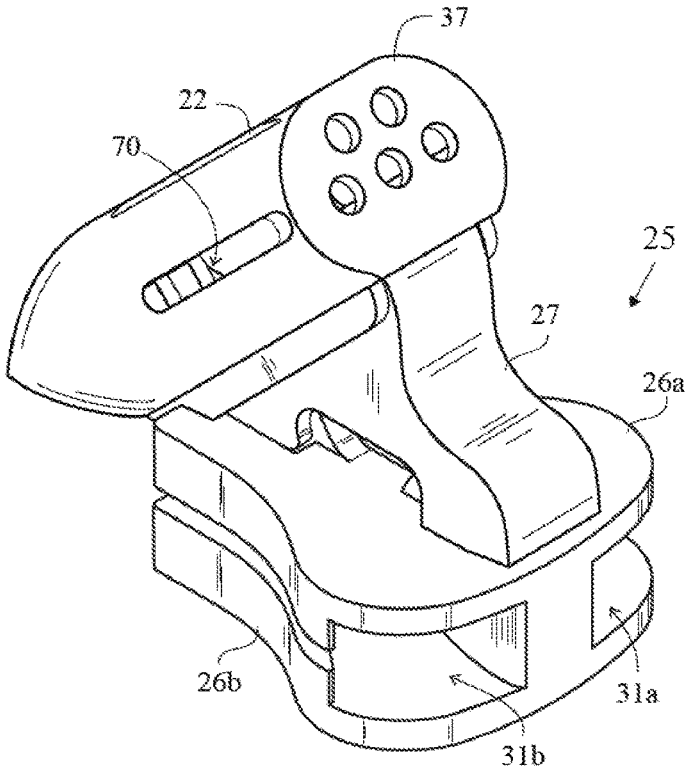
FIG. 13 is a top perspective view of an alternative embedment of a slider for a zipper for generating a distinctive sound.
Figure 14:
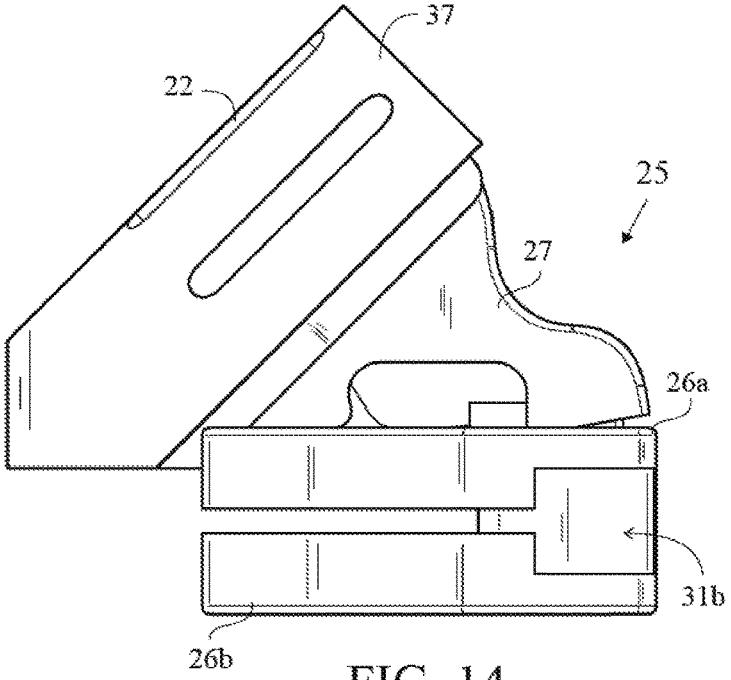
FIG. 14 is a side elevation view of the slider of FIG. 13.
Figure 15:
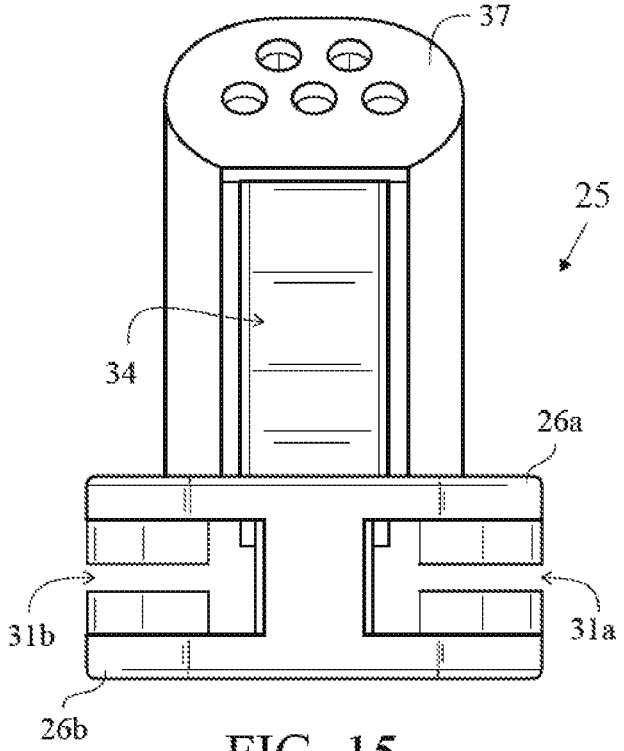
FIG. 15 is a front elevation view of the slider of FIG. 13.
Figure 16:
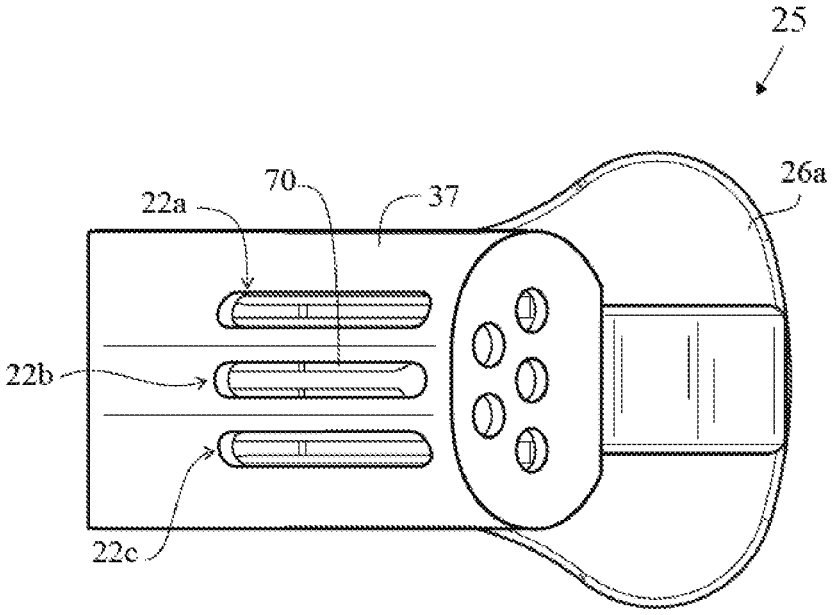
FIG. 16 is a top plan view of the slider of FIG. 13.
Figure 17:
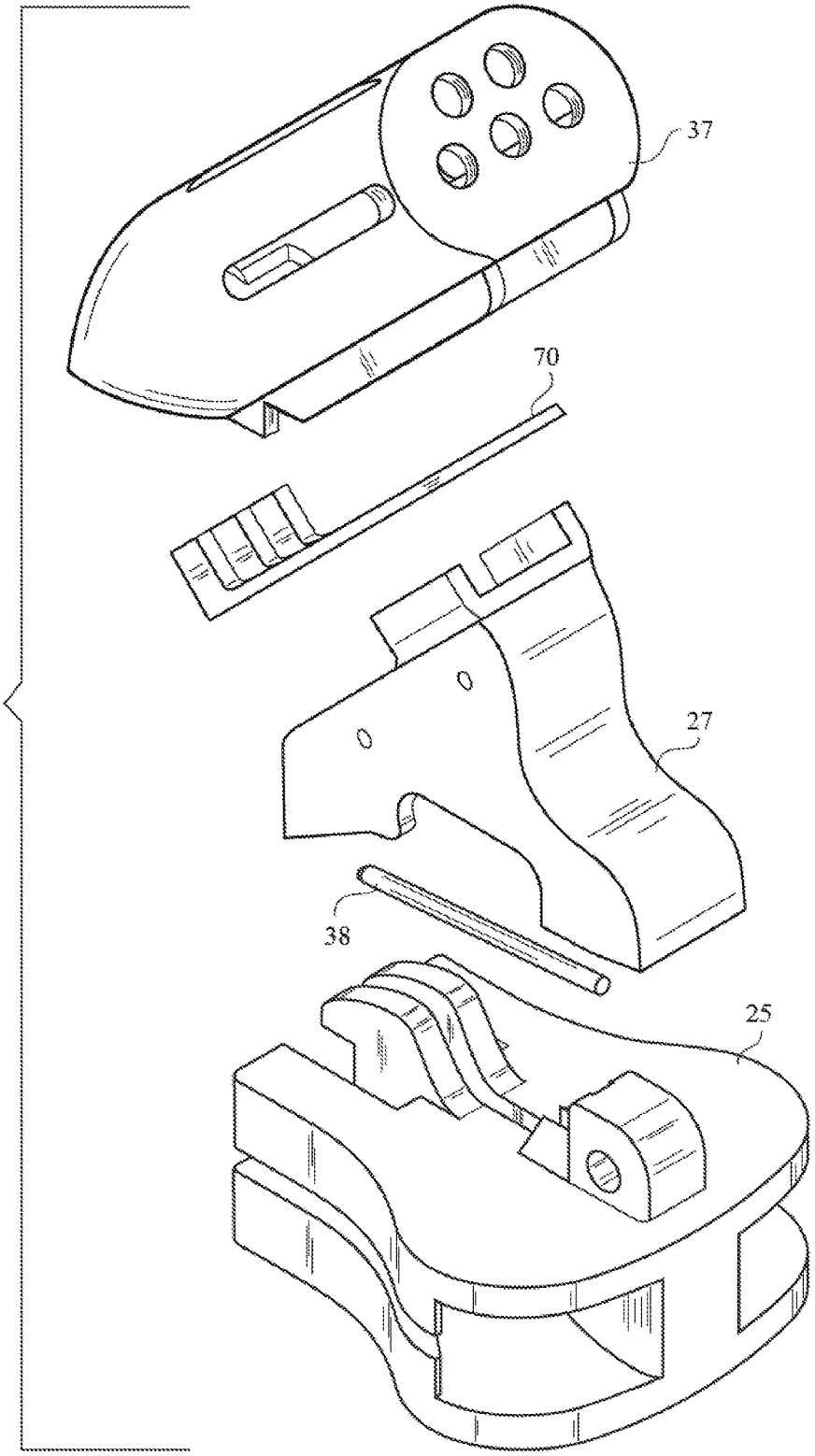
FIG. 17 is an exploded view of the slider of FIG. 13.

As shown in FIGS. 1, 3 and 4, each zipper tooth 40 of the plurality of zipper teeth 40 of the first track 30 and the second track 32 comprises from one to four raised portions 45. As the sliding body 26 is slid over the raised portions 45, the tone bars 29 are struck generating a distinctive sound through the audio openings 22. The sliding body 26 is preferably shaped to have a sound chamber 34 below the audio openings 22 which amplifies the sound generated as the tone bars 29 strike the raised portions.

The distinctive sound is preferably a song, a tone, or a jingle.

The slider 25 is preferably composed of a metal or plastic material. If metal, preferred metals are brass, tin and stainless steel. The slider 25 preferably has a length ranging from 0.5 inch to 2 inches. The tracks 30 and 32 are preferably composed of a metal material, preferably brass, tin or stainless steel.

As shown in FIG. 4, an article of clothing 60 has a zipper 20 capable of generating music or a distinctive sound. The clothing 60 is preferably pants, a jacket, or a shirt. The article of clothing comprises a clothing body 65, a slider 25, a first track 30 and a second track 32. The clothing body 65 has an opening 66 with a first side 67*a* and a second side 67*b*. The slider 25 comprises a plurality of tone bars 29 and a plurality of audio openings 22. The first track 30 comprises a plurality of zipper teeth 40, and is positioned on the first side 67*a* of the clothing body 65. The second track 32 comprises a plurality of zipper teeth 40, and is positioned on the second side 67*b* of the clothing body 65. Each zipper tooth 40 of the plurality of zipper teeth 40 of the first track 30 and the second track 32 comprises at least one raised portion 45. The slider 25 is configured to generate a musical sound when the slider 25 is slid over the first track 30 and the second track 32.

Another aspect of the present invention is an article having a zipper capable of generating music or a distinctive sound. The article is preferably hand bags, luggage, duffels, wallet, or purse. The article comprises a body, a slider, a first and a second track. The body has an opening with a first side and a second side. The slider comprises a plurality of tone bars and a plurality of audio openings. The first track comprises a plurality of zipper teeth, and is positioned on the first side of the body. The second track comprises a plurality of zipper teeth, and is positioned on the second side of the body. Each zipper tooth of the plurality of zipper teeth of the first track and the second track comprises at least one raised portion. The slider is configured to generate a musical sound when the slider is slid over the first track and the second track.

Those skilled in the pertinent art will recognize that the zipper capable of generating music or a distinctive sound may be utilized without type of article requiring a zipper without departing from the scope and spirit of the present invention.

A sound comb 70 is shown in FIGS. 5-8. The sound comb 70 comprises a main body 77, a plurality of prongs 71 with weighted cantilever bases 72. The sound comb 70 preferably has a length Lc ranging from 10 millimeters (mm) to 20 mm, and most preferably 14.9 mm, a thickness Tc ranging from 0.1 mm to 0.5 mm, and most preferably 0.250 mm, a width We ranging from 2 mm to 5 mm, and most preferably 3.35 mm. The bases have a length $L_B$ ranging from 1 mm to 3 mm, and most preferably 1.95 mm, and a thickness $T_B$ ranging from 0.25 mm to 1 mm, and most preferably 0.5 mm. A distance Td preferably ranges from 1 mm to 2 mm, and most preferably is 1.25 mm. The first prong 71*a* preferably has a length $L_{P1}$ ranging from 4 mm to 9 mm, and most preferably 5 mm to 7.25 mm, the second prong 71*b* preferably has a length $L_{P2}$ ranging from 4 mm to 9 mm, and most preferably 5 mm to 8 mm, the third prong 71*c* preferably has a length $L_{P3}$ ranging from 6 mm to 11 mm, and most preferably 7 mm to 9.5 mm. The third prong 71*c* is preferably longer than the second prong 71*b*, and the second prong 71*b* is preferably longer than the first prong 71*a*. The distance between prongs is preferably 1 mm. The sound comb 70 is preferably designed to be a compact 15 mm×3.5 mm×2 mm. The sound comb 70 preferably has multiple prongs 71 depending on how many tones are desired but is limited to the width of the zipper teeth 40 in a combined position. The lengths of the prongs 71 are preferably determined by balancing the Equation:

$$(2\pi f_n)^2 = \frac{Ebh^3}{12L^3(M + 0.23\rho AL)}$$

A frequency for a weighted cantilever beam. The determining factors of the length [L] are: the frequency of the tone desired, the modulus of elasticity [E] and density [ρ] of the material used, the base [b] and height [h] of the cantilever beam, and the mass [M] at the end of the cantilever beam. Carefully balancing these factors produce the lengths of the cantilever beams with the desired tones. Due to the nature of the Equation being quartic, MICROSOFT EXCEL was utilized to balance the equation, with respect to the determining factors, to produce multiple tone's corresponding lengths within a certain allowable frequency tolerance. The properties are shown in the tables in FIG. 18. The frequency tolerance is determined based on what tone is required and how large and forgiving the frequency is (e.g., the tone of tone C1, with a frequency of 32.7 Hz is less forgiving than the tone C4 with a frequency of 261.6 Hz. The tone C4 is more forgiving due to the frequency being larger). The material of the sound comb 70 is preferably 1095 spring steel, which was selected for its specific modulus of elasticity and its density.

One embodiment of a slider 25 for a zipper 20 capable of generating music or a distinctive sound is shown in FIGS. 9-12. The slider 25 has a first body 26*a*, a second body 26*b*, a pull member 27, a first opening 28, and a second openings 31*a* and 31*b*. The sound chamber 34 is preferably below the audio openings 22*a* 22*b* and 22*c*, which are in the sound comb cover 37. The components of the slider are attached to each other using press-fitting, soldering, chemical adhesion, or the like.

An alternative embodiment a slider 25 for a zipper 20 capable of generating music or a distinctive sound is shown in FIGS. 13-17. The slider 25 has a first body 26*a*, a second body 26*b*, a pull member/mounting bracket 27, a first opening 28, second openings 31*a* and 31*b*, a sound comb 70, a sound comb cover 37 and a tension wire 38.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

We claim as our invention the following:

1. A zipper capable of generating music or a distinctive sound, the zipper comprising:

a slider comprising a plurality of tone bars and a plurality of audio openings;

a first track comprising a plurality of zipper teeth;

a second track comprising a plurality of zipper teeth;

wherein each zipper tooth of the plurality of zipper teeth of the first track and the second track comprises at least one raised portion;

wherein the slider is configured to generate a musical sound when the slider is slid over the first track and the second track and the at least one raised portion strikes a tone bar of the plurality of tone bars.

2. The zipper according to claim 1 wherein the slider comprises a first opening and a second opening for joining the first track with the second track and separating the first track from the second track.

3. The zipper according to claim 1 wherein the slider comprises a first body and a second body, wherein the plurality of tone bars and the plurality of audio openings are positioned on the first body.

4. The zipper according to claim 1 wherein the plurality of audio openings ranges from four to twenty openings.

5. The zipper according to claim 1 wherein the plurality of tone bars ranges from four to twenty bars.

6. The zipper according to claim 1 wherein each zipper tooth of the plurality of zipper teeth of the first track and the second track comprises from one to four raised portions.

7. The zipper according to claim 1 wherein the musical sound is a song, a tone, or a jingle.

8. The zipper according to claim 1 wherein the slider is composed of a material selected from the group consisting of stainless steel, brass, tin and plastic.

9. A zipper capable of generating music or a distinctive sound, the zipper comprising:

a slider comprising a mounting bracket, a sound comb and a sound comb cover;

a first track comprising a plurality of zipper teeth;

a second track comprising a plurality of zipper teeth;

wherein each zipper tooth of the plurality of zipper teeth of the first track and the second track comprises at least one raised portion;

wherein the slider is configured to generate a musical sound when the slider is slid over the first track and the second track and the at least one raised portion strikes the sound comb.

10. The zipper according to claim 9 wherein the slider comprises a first opening and a second opening for joining the first track with the second track and separating the first track from the second track.

11. The zipper according to claim 9 wherein the slider comprises a first body and a second body, wherein the sound comb comprising a plurality of prongs with each prong of the plurality of prongs comprising a cantilever base.

12. The zipper according to claim 9 wherein each zipper tooth of the plurality of zipper teeth of the first track and the second track comprises from one to four raised portions.

13. The zipper according to claim 1 wherein the slider is composed of a material selected from the group consisting of stainless steel, brass, tin and plastic.

14. An article having a zipper capable of generating music or a distinctive sound, the article comprising:

a body having an opening with a first side and a second side;

a first track comprising a plurality of zipper teeth, the first track positioned on the first side of the opening of the body;

a second track comprising a plurality of zipper teeth, the second track positioned on the second side of the opening of the body;

a slider comprising a plurality of tone bars and a plurality of audio openings;

wherein each zipper tooth of the plurality of zipper teeth of the first track and the second track comprises at least one raised portion;

wherein the slider is configured to generate a musical sound when the slider is slid over the first track and the second track.

15. The article according to claim 14 wherein the article is selected from hand bags, luggage, duffels, wallet, or purse.

16. The article according to claim 14 wherein the musical sound is a song, a tone, or a jingle.

17. The article according to claim 14 wherein the slider is composed of a material selected from the group consisting of stainless steel, brass, tin and plastic.

18. The article according to claim 14 wherein the plurality of tone bars ranges from four to twenty bars.

19. The article according to claim 14 wherein each zipper tooth of the plurality of zipper teeth of the first track and the second track comprises from one to four raised portions.

20. The article according to claim 14 wherein the plurality of audio openings ranges from four to twenty openings.

* * * * *